United States Patent [19]

Leigh

[11] 4,014,519

[45] Mar. 29, 1977

[54] HYDRAULIC JACK WITH MECHANICAL LOCKING DEVICE

[75] Inventor: Theodore M. Leigh, Cedar Rapids, Iowa

[73] Assignee: FMC Corporation, San Jose, Calif.

[22] Filed: Jan. 30, 1976

[21] Appl. No.: 653,877

[52] U.S. Cl. ..... 254/86 H

[51] Int. Cl.[2] ..... B66F 3/16

[58] Field of Search ..... 154/86 H, 93 R, 93 H, 154/93 VA, 103

[56] References Cited

UNITED STATES PATENTS

| | | | |
|---|---|---|---|
| 2,575,659 | 11/1951 | Ensey et al. | 254/86 H |
| 2,835,142 | 5/1958 | Foster | 254/93 VA |
| 2,934,319 | 4/1960 | Wahlstrom | 254/93 R |
| 3,236,489 | 2/1966 | Mattocks et al. | 254/103 |
| 3,309,062 | 3/1967 | Jansz | 254/43 VA |
| 3,904,177 | 9/1975 | Dalton | 254/103 |

*Primary Examiner*—Al Lawrence Smith
*Assistant Examiner*—Robert C. Watson
*Attorney, Agent, or Firm*—J. F. Verhoeven; J. W. Edwards; C. E. Tripp

[57] ABSTRACT

A hydraulic jack, suitable for use as an outrigger support for a mobile crane, has a cylinder with a piston slidably received therein. Projecting from the piston is a rod that extends axially outward of the cylinder for supporting a load. The rod is externally threaded and a worm wheel nut is internally threaded to fit upon the rod. The nut is held in a fixed, axial position relative to the cylinder, and this nut must rotate on the rod to enable the rod to travel inwardly or outwardly of the cylinder. A rotatable worm is threaded to mesh with worm engaging gear teeth on the periphery of the worm wheel nut. Preferably, the thread on the worm has a helix angle with a self-locking characteristic, but the helix angle of the threads between the worm wheel nut and the piston rod is greater than the angle of friction so that there are no self-locking characteristics. The worm is driven by a hydraulic motor, that is connected with the cylinder in a hydraulic circuit, and a common control valve regulates the operation of both the cylinder and the motor.

9 Claims, 4 Drawing Figures

HYDRAULIC JACK WITH MECHANICAL LOCKING DEVICE

BACKGROUND OF THE INVENTION

1. Field of the Invention

This invention relates to pushing and pulling implements of the fluid pressure type, such as hydraulic jacks. More specifically, the invention concerns a mechanical, self-locking mechanism for holding loads after the hydraulic jack has been placed in a load supporting position.

2. Description of the Prior Art

Hydraulic jacks have been used as outrigger supports for mobile cranes to provide stabilizing support to permit lifting of heavy loads by the crane at the job site. Various means have been used to lock the jacks in an extended position supporting a load. Such means include both hydraulic and mechanical devices.

One type of hydraulic lock consists of a pilot operated check valve that is located at the pressure port of the jack cylinder for locking the hydraulic fluid within the cylinder. When pressure is applied to the cylinder in a jack raising direction, the check valve will unseat and admit more fluid to the cylinder. If pressure is applied to lower the jack, the pressure acting upon a pilot spool will unseat the check valve, to allow the discharge of fluid from the cylinder and the jack to retract. Another type of hydraulic lock is a shut-off valve that is located at the pressure port of the jack cylinder, so that closure of the shut-off valve, either manually, hydraulically or electrically, will block the hydraulic fluid in the cylinder. While such hydraulic locks provide a degree of security against inadvertent lowering of the jack, they do not insure against lowering of the jack due to seepage or leakage of hydraulic fluid, as might occur past the locking valve or from the jack cylinder.

One type of mechanical lock, to prevent the inadvertent retraction of outrigger jacks, consists of locking pins. These pins are inserted into a series of holes, that are located in the jack housings and in the members that are connected to jack rams, so that locking positions can be obtained at discrete intervals through the extension travel range of the jack. This system provides secure locking independently of the hydraulic system. Such locking pins have the disadvantage of requiring manual placement and removal at each jack location. These pins are subject to being lost. The hole spacing for the pins is discrete and requires an "inching" adjustment that is not compatible with random jack extensions. Furthermore, the application of this mechanical lock is left to the option of the crew operating the crane.

Another type of mechanical lock for maintaining a hydraulic outrigger jack in an extended position is a screw lock, as shown in U.S. Pat. No. 3,702,181. A shaft is journalled at the top of a hydraulic cylinder and extends coaxially therein, where it is keyed to a threaded locking member. The shaft is rotated by a handle, located above the cylinder, and upon rotation of the shaft, the locking member moves to a locking position that is located between the piston and one end of the cylinder. The locking member can either be threadedly mounted within the piston and adapted to engage one end of the cylinder or it can be threadedly mounted within one end of the cylinder and adapted to engage the piston. This lock requires a manual setting at each jack location and its application is left to the option of the crew operating the crane.

Another type of screw lock for a hydraulic cylinder is shown in U.S. Pat. No. 2,875,980. A screw, coaxially located within a hydraulic cylinder, threadedly fits through a piston and into a hollow piston rod to lock the piston in a desired position within the cylinder. The screw is connected to a vertical shaft that enters the cylinder through a packing gland. A bevel gear is fixed to the shaft outside of the cylinder and a thrust bearing is fixed to the shaft within the cylinder to hold the shaft in a fixed axial position relative to the cylinder. The bevel gear and shaft are turned by another bevel gear that is mounted upon a shaft. This shaft is turned either manually, by a crank, or automatically, through a suitable drive with an electric motor that is energized when the hydraulic cylinder is actuated. The packing glands provide an additional location for possible leakage of hydraulic fluid from the cylinder.

Another type of screw lock is shown in U.S. Pat. No. 2,284,958. A hydraulic cylinder has a piston therein with an externally threaded piston rod that extends upwardly through the top of the cylinder to a load supporting pad at the upper end of the rod. A nut, that is located on the piston rod portion outside of the cylinder, can be manually adjusted, after the piston rod is in a desired load supporting position, to bear against the top of the cylinder and thereby lock the piston rod in that position. This type of lock requires manual setting and manual releasing at each jack cylinder location and its application is left to the option of the person operating the jack.

The use of a driven worm for turning a worm wheel to raise or lower a jackscrew is shown in U.S. Pat. Nos. 2,234,220; 3,236,489; 3,790,133; and 3,888,464.

SUMMARY OF THE INVENTION

A jack can be raised or lowered at normal hydraulic speeds by a hydraulic system, when the system is activated for such movement. Upon inactivation of the system, a mechanical locking device is set automatically in any position of jack extension, to carry the jack loading and thereby hold the jack in that position. The mechanical locking device has a load supporting capability that is several times greater than such capability of the hydraulic system since the maximum loadings occur when the locking device is set. Thus, lower cost hydraulic components can be used in the hydraulic system without endangering the safety of the overall support system. The jack can be controlled from a remote location by an operator and the time required for setting the jack is minimized because no manual action is required at the jack location to set or release the mechanical locking device. Since the locking device is set automatically, the operator does not have the option of supporting a load in a selected position with only the hydraulic system.

The jack is formed by a hydraulic cylinder having a slidable piston therein with a rod projecting from the piston, through one end of the cylinder, to support a load. Held in a fixed position axially relative to the cylinder is a worm wheel nut that is threadedly fitted upon the piston rod. About the periphery of this worm wheel nut are gear teeth that are engaged by a rotatable worm for rotating the nut, as to travel axially along the piston rod, when the rod is extended or retracted from the cylinder. The rod can be held in a fixed position relative to the cylinder by the worm wheel nut and the rotatable worm which form a mechanical locking device.

In a preferred form of the invention, the rotatable worm is driven by a reversible hydraulic motor that is connected in a hydraulic circuit with the cylinder of the jack. A common control valve is provided for regulating the operation of both the cylinder and the motor. The matching threads on the worm wheel nut and piston rod have a large lead in proportion to their diameter so that the helix angle of the threads is greater than the angle of friction and therefore have no self-locking characteristics. Thus, the worm wheel nut will turn on the piston rod due to the load on the nut, unless the nut is restrained by a force that is applied to the nut by the worm. The matching threads on the worm and on the worm wheel nut have a helix angle that provides a self-locking characteristic to prevent rotation of the worm wheel nut unless the worm is moved. Thus, the worm wheel nut is locked in place by the worm. The piston rod slidably fits within the cylinder and is keyed there to prevent rotation of the rod relative to the cylinder.

DESCRIPTION OF THE PREFERRED EMBODIMENT

Figure 1:
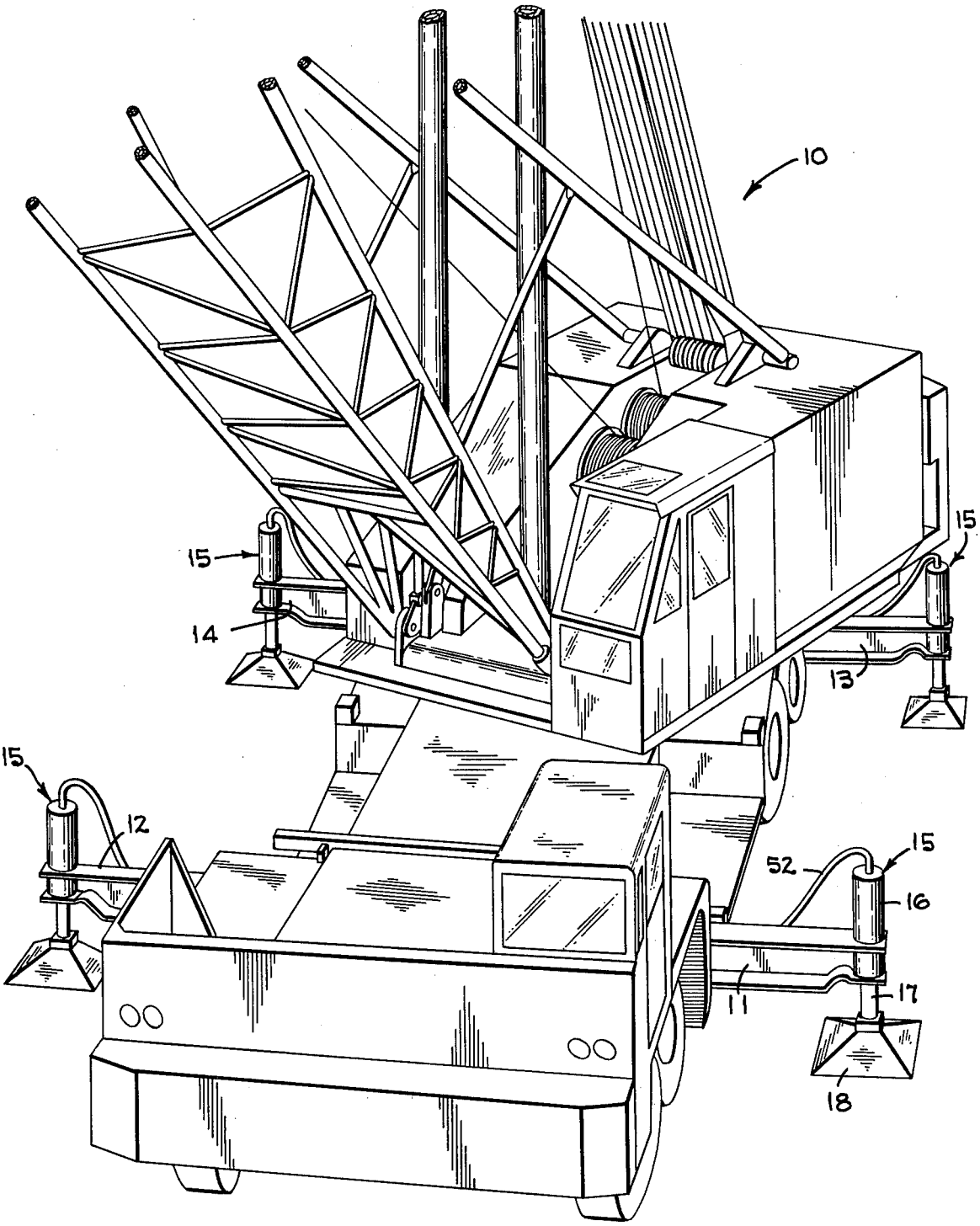
FIG. 1 is a fragmentary, perspective view of a mobile crane that is supported by outrigger jacks embodying the present invention.

With reference to FIG. 1, a mobile crane 10 is supported near its front end by an outrigger beam 11 that extends laterally from the left side of the crane and by an outrigger beam 12 that extends laterally from the right side of the crane. The crane is supported near its rear end by an outrigger beam 13 that extends laterally from the left side of the crane and by an outrigger beam 14 that extends laterally from the right side of the crane. Located at the outermost end of each outrigger beam is a hydraulic jack 15, each jack being given the same reference numeral since these jacks are similar and the present invention is more closely related to an individual jack.

Each hydraulic jack 15 includes a cylinder 16 and a piston rod 17 that extends downwardly from the cylinder. A float 18 is mounted at the lowermost end of the rod for engaging the ground. In order to obtain the most effective use of such outrigger beams and jacks, the jacks are extended until the crane is elevated sufficiently that its wheels are free of the supporting surface. The jacks are further adjusted until the crane is leveled and fully supported on the jacks.

Figure 2:
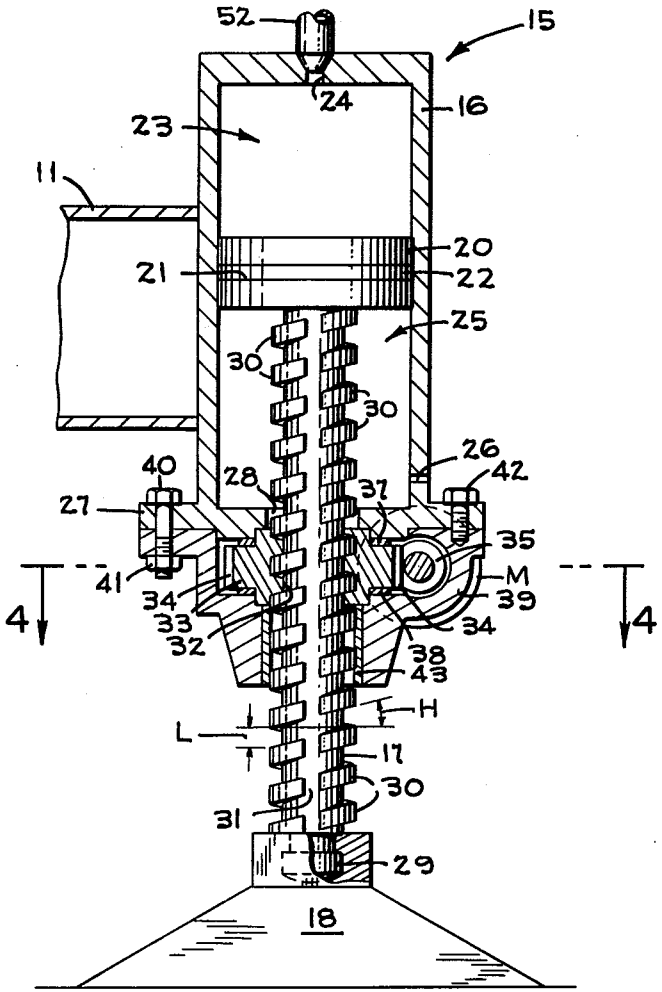
FIG. 2 is a section in elevation of one of the jacks shown in FIG. 1.

Looking now at FIG. 2, it will be seen that a piston 20 is slidably received within the cylinder 16. An annular groove 21 extends around the side of the piston and a seal ring 22 is received within the groove to provide a fluid tight seal between the sides of the piston and the cylinder. A fluid chamber 23 is defined within the upper portion of the cylinder at a location above the piston. A port 24, that is located in the top of the cylinder, provides flow commuication between the fluid chamber and a source of fluid pressure. A chamber 25 is defined within the lower portion of the cylinder at a location below the piston and a vent 26 extends through the cylinder wall between the chamber 25 and the outside atmosphere. A coupling flange 27 projects laterally outward from the lower end of the cylinder and at the bottom of the cylinder is a central bore 28 through which the piston rod 17 fits.

The piston rod 17 is attached to the piston 20 and this rod extends downwardly from the piston, through the central bore 28, to a coupling end 29 that engages the float 18. A helical series of threads 30 are provided on the piston rod and these threads have a helix angle H that is greater than the angle of friction so as to have no self-locking characteristics. This angle is the angle made by the helix of the thread, at the pitch diameter, with a plane perpendicular to the axis of the helix. When the lead L is large in proportion to the pitch diameter, the helix angle is large. When this angle is greater than the angle of friction, a load upon the threads of a rotating part, such as a nut or a screw, will cause rotation of the part due to the load alone, unless prevented by a locking force. A keyway 31 is cut longitudinally of the piston rod throughout the length of the helical series of threads. A key, not shown, that is located at or near the cylinder bottom, engages this keyway with a sliding fit to prevent rotation of the piston rod relative to the cylinder.

Figure 4:
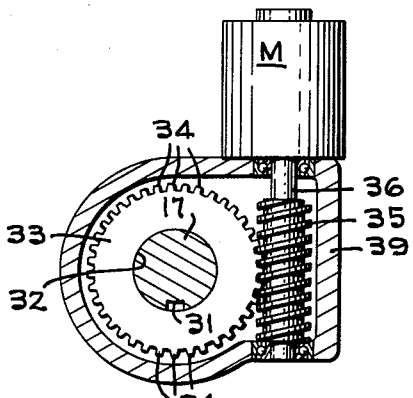
FIG. 4 is a section taken on the line 4—4 of FIG. 2.

A worm wheel nut 33 has a central bore 32 that is threaded to mate with the piston rod threads 30 and worm engaging teeth 34 are provided on the periphery of the nut. These teeth are engaged by a worm 35 on a shaft 36 that is driven by a reversible hydraulic motor M. The shaft 36 is journalled at both ends within a housing 39 as shown in FIG. 4. The thread of the worm has a helix angle that is less than the angle of friction and thus provides a self-locking characteristic against rotation of the worm due to loading thereon. The worm wheel nut 33 is held in place between a top annular thrust bearing 37 that abuts the bottom of the cylinder 16 and a bottom annular thrust bearing 38 that is supported by a housing 39.

The housing 39 is connected to the coupling flange 27 of the cylinder 16 by bolts 40 with nuts 41 threadedly fitted thereon and by cap screws 42. A guide bushing 43 is mounted in the housing to provide lateral support for the housing and cylinder against the threads of the piston rod 17. The key, not shown, for engaging the keyway 31 can project from either this guide bushing or from the cylinder bottom at the bore 28.

Figure 3:
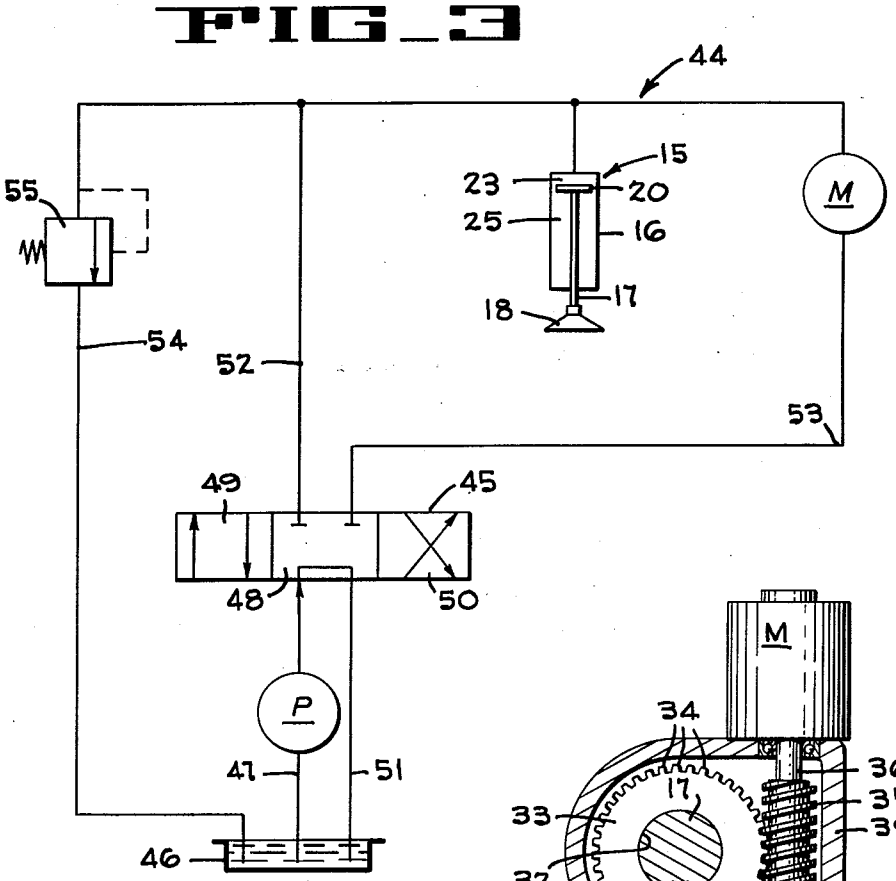
FIG. 3 is a hydraulic circuit diagram for operating the jack shown in FIG. 2.

As illustrated in FIG. 3, the cylinder 16 and the motor M are connected in a hydraulic circuit 44 with a common control valve 45 for regulating the fluid flow to the cylinder and to the motor. Fluid is drawn from a sump 46, through a line 47, by a pump P and directed to the control valve, which has valve positions 48, 49 and 50. In valve position 48 for holding the jack in a given position fluid from line 47 is returned to the sump through a line 51 and the circuit is blocked to the cylinder and the motor. When the valve is moved to the jack elevating position 49, fluid flows directly from the line 47 to a line 52 that supplies both the cylinder and the motor M. Fluid discharged from the motor is returned by a line 53, through the valve, to the line 51 that goes to the sump. When the valve is moved to the jack lowering position 50, fluid flows through the valve from the line 47 to the line 53, through the motor to the line 52, and through the valve again from the line 52 to the line 51 that goes to the sump. A return line 54 extends around the valve from the line 52 to the sump. A pressure relief valve 55 is provided in this line to open when the pressure in the line 52 becomes excessive and equals the relief valve setting. Such excess pressure can be caused by temperature changes when the hydraulic circuit is locked with the control valve in the jack holding position 48.

To set the jack 15, the control valve 45 is moved to the jack elevating position 49. Hydraulic fluid is directed from the pump P to both the cylinder 16 and to the motor M. The motor drives the worm 35, which rotates the worm wheel nut 33, to keep up with the movement of the cylinder 16 relative to the piston 20. It should be noted that the pressure within the fluid chamber 23 elevates the cylinder 16 relative to the piston 20 because the motor M does not have sufficient power to elevate the jack under load.

When the jack 15 has raised the outrigger beam 11 to the desired position, the control valve 45 is moved to the jack holding position 48 where hydraulic fluid is blocked to and from both the cylinder 16 and the motor M. At this time, the worm wheel nut 33 is locked in place on the piston rod 17 by action of the self-locking threads on the worm 35 and the teeth 34 on the worm wheel nut, as well as by the blocking action of the blocked hydraulic fluid in the positive displacement motor. Pressure within the fluid chamber 23 is determined by the weight being supported which corresponds to a proportional part of the dead load of the crane 10. When a live load is imposed upon the jack by swinging movement of the crane or by the crane picking up a load, the pressure within the fluid chamber is not increased because this load is transmitted directly from the cylinder 16, through the top thrust bearing 37 and the locked worm wheel nut, to the piston rod 17. Any leakage of hydraulic fluid from the cylinder or the connected hydraulic system, or seepage of hydraulic fluid through the motor, will not result in a lowering or collapse of the jack, because the load is transmitted from the cylinder, through the top thrust bearing and the locked worm wheel nut, to the piston rod.

To lower the jack 15, the control valve 45 is moved to the jack lowering position 50. The lines 52 and 51 are coupled to discharge fluid from the fluid chamber 23 to the sump 45 and the lines 47 and 53 are coupled to provide power to retract the jack. The release of pressure from the fluid enables the dead load upon the cylinder 16 to bear upon the worm wheel nut 33 and this tends to rotate the nut which is also being rotated by the worm 35 that is driven by the hydraulic motor M. Such rotation of the nut enables retracting movement of the piston rod 17 inward of the cylinder. Once the float 18 is lifted from the ground, the hydraulic motor M through the worm and worm wheel nut completes retracting the piston rod into the cylinder.

From the foregoing description it will be seen that the jack 15 has a hydraulic system for raising and lowering at normal hydraulic speeds and a mechanical locking device that sets automatically in any position of jack extension to carry the jack loading upon inactivation of the hydraulic system. This jack is controlled from a remote location by an operator that does not have the option of supporting a load in a selected position with only the hydraulic system. This jack can be rapidly set and released.

Although the best mode contemplated for carrying out the present invention has been herein shown and described, it will be apparent that modification and variation maybe made without departing from what is regarded to be the subject matter of the invention.

What is claimed is:

1. In a jack of the type having a cylinder, a piston slidably received within the cylinder, and a piston rod projecting from the piston outwardly of the cylinder, the improvement comprising a worm wheel nut that is threadedly engaged upon the piston rod, a rotatable worm that is engaged with the worm wheel nut, and a motor to rotate the worm, said worm wheel nut being held at a fixed location relative to the cylinder but being rotatable about the piston rod to enable the rod to travel axially of the cylinder said cylinder being a single acting hydrualic cylinder and the threads between the piston rod and the worm wheel nut having a helix angle that is greater than the angle of friction so that in response to loading thereon the worm wheel nut will rotate on the piston rod to enable retraction of the rod within the cylinder.

2. The improvement described in claim 1 wherein the threads between the worm and worm wheel nut have a helix angle that provides self-locking against loading.

3. The improvement described in claim 1 in which the motor for rotating the worm is a reversible hydraulic motor.

4. The improvement described in claim 3 including a hydraulic circuit connecting the hydraulic motor and the cylinder, and a common control valve for regulating the operation of both the cylinder and the motor.

5. The improvement described in claim 1 including a keyway that extends longitudinally of the piston rod and a key projecting from the cylinder to slidably fit within the keyway and thereby prevent the piston rod from rotating relative to the cylinder.

6. A hydraulic jack comprising in combination, a cylinder, a piston slidably received in the cylinder and having a threaded piston rod extending from the cylinder, a nut rotatably mounted outside the cylinder in fixed axial relation to the cylinder, said nut having internal threads engaged with the threads on said piston rod and having external threads, a rotatable worm engaged with the external threads on said nut, and a motor to rotate said worm, said threads between the piston rod and the nut having a helix angle that is greater than the angle of friction so that in response to loading thereon the nut will rotate on the piston rod to enable retraction of the rod within the cylinder and said threads between the worm and the nut having a helix angle that provides self-locking against loading thereon.

7. A hydraulic jack comprising in combination, a cylinder, a piston slidably received in the cylinder and having a threaded piston rod extending from the cylinder, means defining a housing connected to the cylinder, a nut rotatably mounted in said housing, said nut having internal threads engaged with the threads on said piston rod and having external threads, a rotatable worm mounted in said housing and engaged with the external threads on said nut, and a reversible hydraulic motor to drive said worm to permit retraction and extension of the piston rod into and out of the cylinder, said threads between the worm and the nut having a helix angle that provides self-locking against loading on the nut.

8. The combination of claim 7 wherein said motor is relatively low powered to rotate the worm only when the jack loading is not transmitted through the nut.

9. The combination of claim 7 including hydraulic means for introducing fluid under pressure between the piston and the cylinder for supporting the jack loading and for moving the cylinder relative to the piston.

* * * * *